US011394100B2

(12) United States Patent
Tanobe et al.

(10) Patent No.: US 11,394,100 B2
(45) Date of Patent: Jul. 19, 2022

(54) HIGH-FREQUENCY CONNECTION STRUCTURE FOR CONNECTING A COAXIAL LINE TO A PLANAR LINE USING ADHESION LAYERS

(71) Applicant: Nippon Telegraph and Telephone Corporation, Tokyo (JP)

(72) Inventors: Hiromasa Tanobe, Tokyo (JP); Satoshi Tsunashima, Tokyo (JP)

(73) Assignee: NIPPON TELEGRAPH AND TELEPHONE CORPORATION, Tokyo (JP)

( * ) Notice: Subject to any disclaimer, the term of this patent is extended or adjusted under 35 U.S.C. 154(b) by 0 days.

(21) Appl. No.: 17/047,920

(22) PCT Filed: Apr. 8, 2019

(86) PCT No.: PCT/JP2019/015301

§ 371 (c)(1),
(2) Date: Oct. 15, 2020

(87) PCT Pub. No.: WO2019/203045

PCT Pub. Date: Oct. 24, 2019

(65) Prior Publication Data

US 2021/0167479 A1 Jun. 3, 2021

(30) Foreign Application Priority Data

Apr. 18, 2018 (JP) ..... JP2018-079624

(51) Int. Cl.

| | |
|---|---|
| ***H01P 5/08*** | (2006.01) |
| ***H01P 3/00*** | (2006.01) |
| ***H01P 5/107*** | (2006.01) |

(52) U.S. Cl.
CPC ..... *H01P 5/085* (2013.01); *H01P 3/003* (2013.01); *H01P 5/107* (2013.01)

(58) Field of Classification Search
CPC ..... H01P 5/085
USPC ..... 333/33
See application file for complete search history.

(56) References Cited

U.S. PATENT DOCUMENTS

| | | | | |
|---|---|---|---|---|
| 9,287,604 | B1 * | 3/2016 | Noujeim | H01P 5/085 |
| 2003/0206084 | A1 * | 11/2003 | Tamaki et al. | H05K 1/0219 333/260 |
| 2006/0284699 | A1 * | 12/2006 | Weiske | H01P 5/085 333/33 |
| 2007/0264872 | A1 * | 11/2007 | Kuroda et al. | H05K 1/0243 439/581 |

FOREIGN PATENT DOCUMENTS

| | | |
|---|---|---|
| JP | 3144576 B2 | 3/2001 |

* cited by examiner

*Primary Examiner* — Benny T Lee
(74) *Attorney, Agent, or Firm* — Slater Matsil, LLP

(57) ABSTRACT

A high-frequency line connection structure 1 for connecting a coaxial line and a planar line includes a conductive second adhesion layer that is formed along edges of a pair of first conductive thin films of the planar line. Furthermore, end portions of the pair of first conductive thin films and an end portion of a second conductive thin film that is adjacent to the coaxial line are disposed to coincide with a position of an inner wall of a columnar penetrating hole formed in an outer conductor.

17 Claims, 11 Drawing Sheets

HIGH-FREQUENCY CONNECTION STRUCTURE FOR CONNECTING A COAXIAL LINE TO A PLANAR LINE USING ADHESION LAYERS

CROSS-REFERENCE TO RELATED APPLICATIONS

This application is a national phase entry of PCT Application No. PCT/JP2019/015301, filed on Apr. 8, 2019, which claims priority to Japanese Application No. 2018-079624, filed on Apr. 18, 2018, which applications are hereby incorporated herein by reference.

TECHNICAL FIELD

The present invention relates to a high-frequency line connection structure, and more particularly, to a technique of connecting a coaxial line and a planar line.

BACKGROUND

In recent years, in the field of optoelectronics, a high-frequency interface constituting an optoelectronic component is required to have low reflection characteristics and a low insertion loss over a wide frequency range. The structure of such a high-frequency interface adopts a mode of using a lead pin and a flexible printed circuit, but may, in some cases, use a coaxial interface.

Particularly, electronic components and optical module components having a 1 mm interface with band characteristics at 100 GHz or higher are expected to be used as key components for next-generation optical communication at 1 Tbps or more, and are being developed in and outside of Japan.

Various components are disposed on a plane inside an electronic component or an optical module component as described above, and a high-frequency line that electrically connects the various components is generally fabricated on an insulating dielectric substrate. For its part, the 1 mm interface has a coaxial line structure including an inner conductor and a cylindrical ground, which is clearly different from the structure of the high-frequency line that is fabricated on the dielectric substrate described above.

Because of such a difference in the structures, a new connection mechanism for a high-frequency line is desired to be implemented, the new connection mechanism having a low insertion loss with respect to high-frequency characteristics and low return loss characteristics at a connection part at which a high-frequency line fabricated on a dielectric substrate and a coaxial line are mechanically and electrically connected.

Accordingly, Patent Literature 1 discloses a high-frequency line connection structure 500A as shown in FIG. 5A, where an inner conductor 514 constituting a coaxial line 510 is structured to protrude from a line end, the inner conductor 514 is electrically connected to a signal line 522 at a line end of a grounded coplanar line 520, and a dielectric layer 513 and a radio wave absorption layer 500 are disposed on a connection part.

More specifically, as shown in FIG. 5A, with the high-frequency line connection structure 500A, the coaxial line 510 and the grounded coplanar line 520 are connected.

The coaxial line 510 includes a cylindrical earth ground 511 covered by the radio wave absorption layer 500, an insulator 512 filling the inside of the earth ground 511, and the inner conductor 514 covered by the insulator 512. A part at a line end of the coaxial line 510 where the inner conductor 514 protrudes is covered by the dielectric layer 513.

The grounded coplanar line 520 includes a pair of grounds 521 formed on a surface of a dielectric substrate 523, the signal line 522 formed sandwiched between the pair of grounds 521 while being separated by predetermined distances, and an earth ground 524 formed on a back surface of the dielectric substrate 523. Furthermore, the grounded coplanar line 520 is formed on metal bases 530, 540.

With the high-frequency line connection structure 500A, a fundamental mode of electromagnetic waves to be propagated is different between the coaxial line 510 and the grounded coplanar line 520. Accordingly, the dielectric layer 513 is introduced for the purpose of facilitating conversion of the fundamental mode at a connection section 550 (see FIGS. 5D and 5E), and the radio wave absorption layer 500 is introduced for the purpose of absorbing unwanted radiation occurring at the connection section 550.

An increase in the insertion loss or a return loss is thereby suppressed at the high-frequency line connection structure 500A. Therefore, according to frequency characteristics of the insertion loss and frequency characteristics of the return loss at the high-frequency line connection structure 500A, ripple and dip are removed, and desirable transmission characteristics may be obtained over a wide band.

However, the dielectric layer 513 causes a high-frequency loss. Furthermore, energy that is a source of unwanted radiation that is absorbed by the radio wave absorption layer 500 is based on a high-frequency signal that is propagated through a line. Accordingly, the high-frequency line connection structure 500A is a connection mechanism which assumes occurrence of energy loss at the connection section 550. Generally, with respect to a high-frequency signal at a high frequency such as 100 GHz, an output amplitude at an IC or the like that generates the high-frequency signal is small in the first place. Moreover, it is commonly known that unwanted radiation is more notably generated, as the frequency increases.

Accordingly, in a case where a high-frequency signal at a high frequency such as 100 GHz is propagated by the high-frequency line connection structure 500A, the return loss is effectively reduced by the radio wave absorption layer 500, but there is still an occurrence of energy loss, and a total equivalent loss is reduced.

FIGS. 5B and 5C are perspective views showing main structures of the high-frequency line connection structure 500A shown in FIG. 5A, excluding the dielectric layer 513 and the radio wave absorption layer 500. FIGS. 5D and 5E are side views of the high-frequency line connection structure 500A shown in FIGS. 5B and 5C.

An arrow drawn in the side view shown in FIG. 5D indicates a high-frequency signal path P1. Furthermore, an arrow drawn in the side view shown in FIG. 5E indicates a return current path P2 corresponding to the high-frequency signal in FIG. 5D. As shown in FIGS. 5D and 5E, the arrows have different lengths, and there is concern that apparent reflection will appear at a frequency corresponding to $\lambda/4$ the difference in the lengths.

FIG. 6 shows calculation results of a return loss and an insertion loss of the high-frequency line connection structure 500A. As shown in FIG. 6, a dip appears in the return loss at a specific frequency, and the insertion loss is deteriorated at the frequency. In this manner, with the high-frequency line connection structure 500A, because different line structures are connected, deterioration in the return loss is caused due to a bypass of a return current path at the connection part.

CITATION LIST

Patent Literature

Patent Literature 1: Japanese Patent No. 3144576, published Mar. 12, 2001.

SUMMARY OF THE INVENTION

Technical Problem

As described above, and referring to FIGS. 5A, 5B, 5C, 5D, and 5E, with the high-frequency line connection structure 500A described in Patent Literature 1 including the dielectric layer 513 and the radio wave absorption layer 500 (see FIGS. 5A-5E), it is difficult to achieve a connection structure having low-loss characteristics and a superior return loss.

Embodiments of the present invention have been made to solve the problems described above, and has as its object to provide a high-frequency line connection structure having a low return loss, and having low insertion loss characteristics over a wide band.

Means for Solving the Problem

To solve the problems described above, a high-frequency line connection structure according to embodiments of the present invention is a high-frequency line connection structure for connecting a coaxial line and a planar line, where the coaxial line includes an inner conductor extending in an axial direction, the inner conductor having a cross-section formed in a circular shape around an axis, the cross-section being perpendicular to the axial direction, an outer conductor including a penetrating hole for housing the inner conductor, the penetrating hole having a columnar shape, and an insulation layer for insulating between the inner conductor and the outer conductor, the insulation layer being provided in the penetrating hole between the inner conductor and the outer conductor the inner conductor includes a leading end portion extending in the axial direction from an end surface of the outer conductor, the planar line includes a substrate that is formed of dielectric, a signal line that is formed on a surface of the substrate, the signal line having a strip-shape, a pair of first conductive thin films that are formed in regions, on the surface of the substrate, that are adjacent to the coaxial line, the pair of first conductive thin films being formed on respective sides of the signal line across a predetermined distance, and a second conductive thin film that covers a back surface of the substrate, the second conductive thin film being electrically connected to the pair of first conductive thin films, the high-frequency line connection structure includes a first adhesion layer that is conductive, and that is formed to cover the leading end portion of the inner conductor and an end of the signal line included in the planar line, and a second adhesion layer that is conductive, and that is formed on a side of the coaxial line along edges of the pair of first conductive thin films included in the planar line to connect the pair of first conductive thin films and the outer conductor of the coaxial line, and when seen along the axial direction, end portions of the pair of first conductive thin films that are close to the signal line coincide with a position of an inner wall of the penetrating hole formed in the outer conductor and having the columnar shape.

Furthermore, with the high-frequency line connection structure according to embodiments of the present invention, when viewed along the axial direction, an end portion of the second conductive thin film that is adjacent to the coaxial line may coincide with the position of the inner wall of the penetrating hole formed in the outer conductor and having the columnar shape.

Furthermore, with the high-frequency line connection structure according to the embodiments of present invention, a length of the substrate of the planar line in a direction perpendicular to a lengthwise direction of the signal line may be smaller than a radius of a concentric circle of the coaxial line, a cutaway part may be formed in the second conductive thin film of the planar line, the cutaway part may be formed by selectively removing a region including a connection section as viewed from top, the connection section being formed by connecting the leading end portion of the inner conductor of the coaxial line and a part of a surface of the planar line by the first adhesion layer, and the coaxial line of the second conductive thin film and an end portion of the second conductive thin film that is adjacent to the cutaway part may coincide with the position of the inner wall of the penetrating hole formed in the outer conductor and having the columnar shape.

Furthermore, with the high-frequency line connection structure according to embodiments of the present invention, the planar line may further include a plurality of through holes for providing electrical continuity between the pair of first conductive thin films and the second conductive thin film, the through holes penetrating the substrate.

Furthermore, with the high-frequency line connection structure according to the embodiments of present invention, the planar line may further include a plurality of half through holes for providing electrical continuity between the pair of first conductive thin films and the second conductive thin film, the half through holes being formed in an end surface of the substrate that is adjacent to the coaxial line in a manner penetrating the substrate, and the second adhesion layer may fill the plurality of half through holes.

Effects of Embodiments of the Invention

According to embodiments of the present invention, end portions of an opposing pair of first conductive thin films included in a planar line that are adjacent to a coaxial line, and an end portion of a second conductive thin film that is adjacent to the coaxial line are disposed to coincide with a position of an inner wall of a columnar penetrating hole formed in an outer conductor included in the coaxial line, and a second adhesion layer is formed along edges of the pair of first conductive thin films that are adjacent to the coaxial line, and thus, a high-frequency line connection structure having a low return loss, and having low insertion loss characteristics over a wide band may be achieved.

DETAILED DESCRIPTION OF ILLUSTRATIVE EMBODIMENTS

Hereinafter, preferred embodiments of the present invention will be described in detail with reference to FIGS. 1A, 1B, 1C, 1D, 2, 3A, 3B, 3C, 3D, 4A, 4B, 4C, 4D, and 4E. Structural elements common among the drawings are denoted by same reference signs.

First Embodiment

Figure 1A:
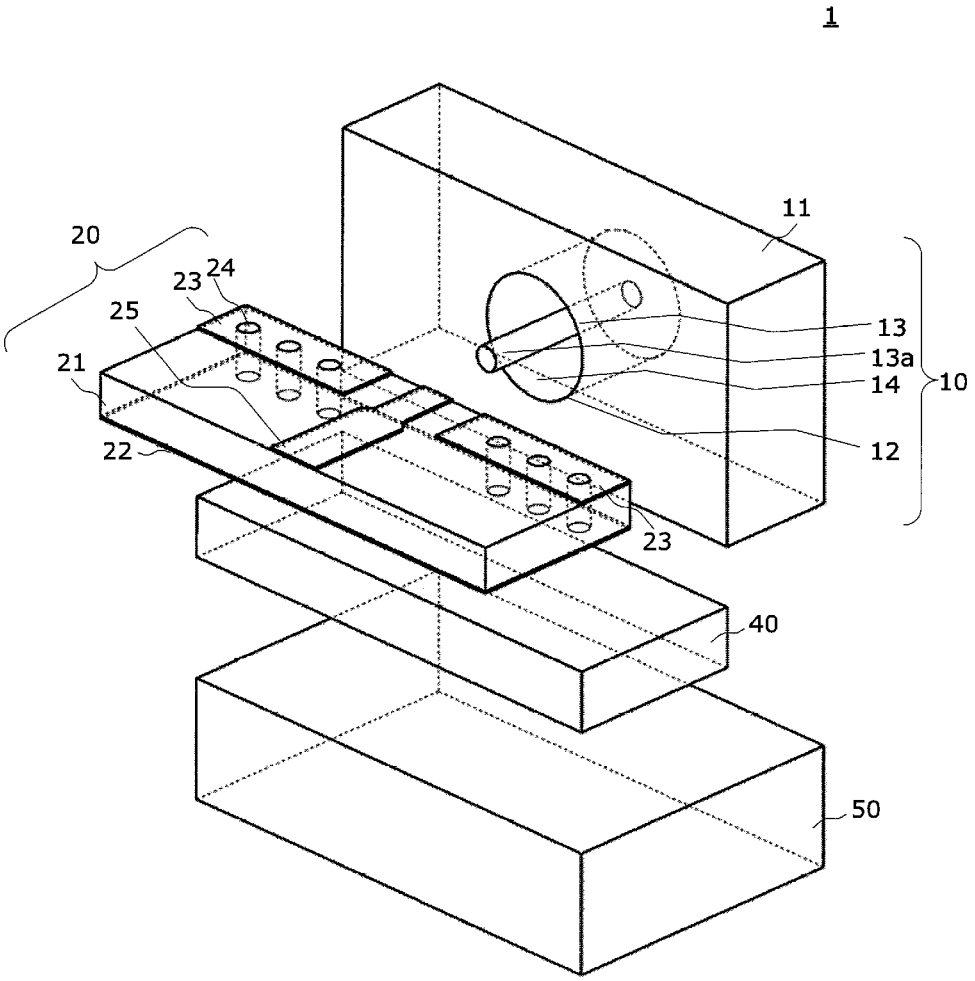
FIG. 1A is an exploded view of a high-frequency line connection structure according to a first embodiment of the present invention.
Figure 1B:
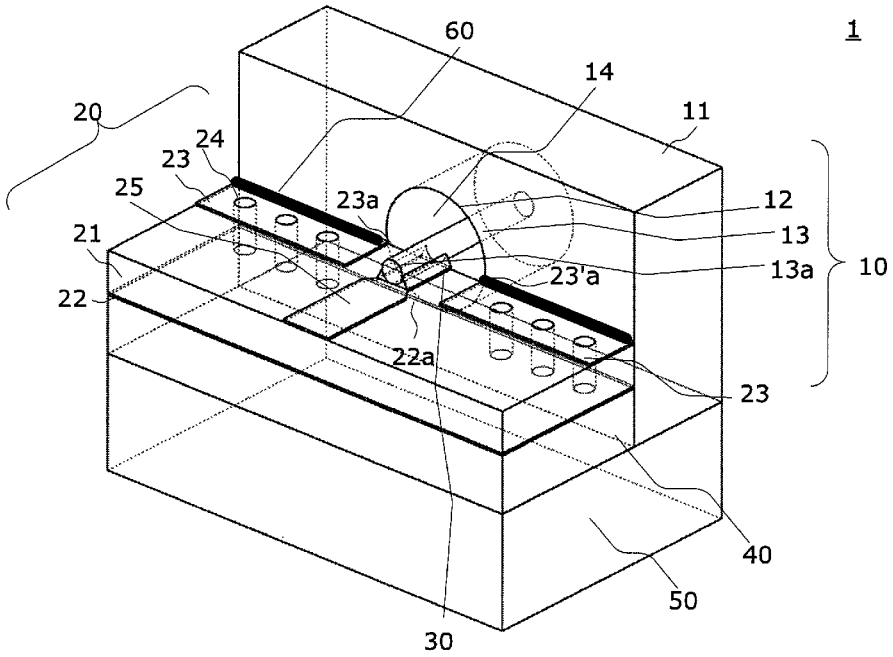
FIG. 1B is a perspective view of the high-frequency line connection structure according to the first embodiment of the present invention.

FIG. 1A is an exploded view of a high-frequency line connection structure 1 according to a first embodiment. FIG. 1B is a perspective view of the high-frequency line connection structure 1. Furthermore, FIG. 1C is a side view of the high-frequency line connection structure 1.

Figure 1C:
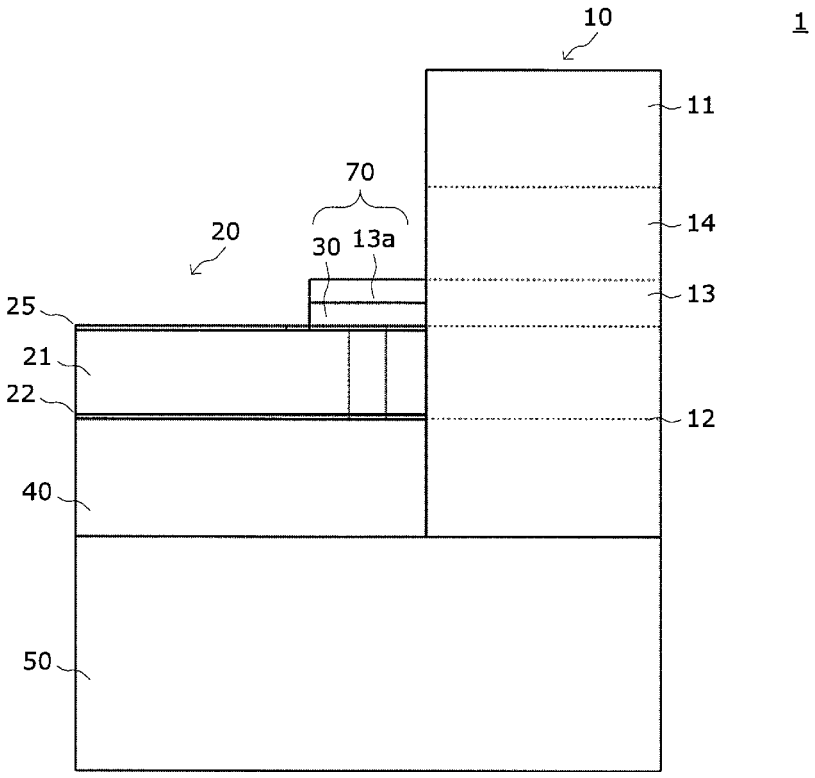
FIG. 1C is a side view of the high-frequency line connection structure according to the first embodiment of the present invention.

As shown in FIGS. 1A to 1C, a coaxial line 10 and a planar line 20 are disposed on a cuboid metal base 50, and are connected to each other. Furthermore, an outer conductor 11 of the coaxial line 10 is disposed on one surface of the metal base 50, and the planar line 20 is disposed on the same surface of the metal base 50 across a metal base 40.

The high-frequency line connection structure 1 according to the present embodiment includes the coaxial line 10, the planar line 20, a first adhesion layer 30 (see FIGS. 1B and 1C), the metal base 40, the metal base 50, and a second adhesion layer 60 (see FIG. 1B).

The coaxial line 10 includes the outer conductor 11, an inner wall 12 of the outer conductor 11, an inner conductor 13, and an insulation layer 14. The outer conductor 11, the inner wall 12 of the outer conductor 11, and the inner conductor 13 are formed to have a coaxial structure.

The outer conductor 11 is formed to have a block shape, and includes, on the inside, a columnar penetrating hole that extends in an axial direction. The outer conductor 11 houses the inner conductor 13 in the columnar penetrating hole. The outer conductor 11 is formed from a metal material. As shown in FIGS. 1A and 1B, the columnar penetrating hole formed in the outer conductor 11 is formed coaxially with the inner conductor 13.

The inner wall 12 is an inner peripheral surface at the columnar penetrating hole formed in the outer conductor 11, and is formed into a cylindrical shape. Furthermore, predetermined end portions that are of a pair of first conductive thin films 23 (see FIGS. 1A and 1B) and a second conductive thin film 22 (see FIGS. 1A and 1B) of the planar line 20 described later and that are adjacent to the coaxial line 10 are aligned and positioned to coincide with the position of the inner wall 12 when seen along the axial direction.

A cross-section of the inner conductor 13 that is perpendicular to the axial direction is formed to have a circular shape around the axis. The inner conductor 13 is a signal core wire of the coaxial line 10 formed by including the inner wall 12 of the outer conductor 11 and the insulation layer 14.

As shown in FIGS. 1A and 1B, the inner conductor 13 includes a leading end portion 13*a* extending in the axial direction from an end surface of the block-shaped outer conductor 11. The leading end portion 13*a* of the inner conductor 13 is electrically connected to a signal line 25 provided on a surface of the planar line 20 by the first adhesion layer 30 (see FIGS. 1B and 1C). The inner conductor 13 is formed from a metal material.

The insulation layer 14 is provided in the penetrating hole between the inner conductor 13 and the outer conductor 11, and insulates between the inner conductor 13 and the outer conductor 11.

Next, a description will be given of the planar line 20 to which the coaxial line 10 is connected.

The planar line 20 is on an extension of the coaxial line 10 that is formed from the outer conductor 11, the inner wall 12, the inner conductor 13, and the insulation layer 14.

The planar line 20 includes a substrate 21, the second conductive thin film 22, the pair of first conductive thin films 23, through holes 24, and the signal line 25.

The planar line 20 is provided on a surface of the metal base 40. The planar line 20 forms a well-known grounded coplanar line at a connection section 70 where the leading end portion 13*a* of the inner conductor 13 of the coaxial line 10 is connected.

The substrate 21 is a planar substrate formed of dielectric. For example, the substrate 21 may be formed of low-loss ceramics such as alumina. The signal line 25 and the pair of first conductive thin films 23 are formed on a surface of the substrate 21, the pair of first conductive thin films 23 being formed on respective sides of the signal line 25 across a predetermined distance. Moreover, the second conductive thin film 22 is disposed on a back surface of the substrate 21.

The second conductive thin film 22 is formed covering the entire back surface of the substrate 21. The second conductive thin film 22 is disposed on a surface of the metal base 40. The second conductive thin film 22 serves as a ground of the planar line 20 of a grounded coplanar line type.

An end portion 22*a* (see FIG. 1B) of the second conductive thin film 22 that is adjacent to the coaxial line 10 is positioned to coincide with the position of the inner wall 12 of the outer conductor 11 of the coaxial line 10, and is electrically connected to the inner wall 12 by solder, conductive adhesive or the like (not shown).

The pair of first conductive thin films 23 are formed in regions, on the surface of the substrate 21, that are adjacent to the coaxial line 10, on respective sides of the signal line 25 across a predetermined distance. The predetermined distance of the pair of first conductive thin films 23 from the signal line 25 may be set such that characteristic impedance of the planar line 20 takes a predetermined value.

End portions 23*a*, 23'*a* (see FIG. 1B) of the pair of first conductive thin films 23 that are close to the signal line 25 are disposed to coincide with the position of the inner wall 12 of the columnar penetrating hole formed in the outer conductor 11 of the coaxial line 10, and are electrically connected to the inner wall 12 by solder, conductive adhesive or the like (not shown).

A plurality of through holes 24 are formed penetrating the substrate 21 from the surface to the back surface. More specifically, a conductive material is vapor-deposited or filled on inner wall surfaces of the through holes 24, and the through holes 24 electrically connect and provide electrical continuity between the pair of first conductive thin films 23 formed on the surface of the substrate 21 and the second conductive thin film 22 formed on the back surface. Because the plurality of through holes 24 are formed, the pair of first conductive thin films 23 become more stable equipotential surfaces. The plurality of through holes 24 are formed along a direction perpendicular to a lengthwise direction of the signal line 25, in regions where the pair of first conductive thin films 23 are formed and with predetermined spaces therebetween. An appropriate space may be selected as the space between the plurality of through holes 24 taking into account the characteristics of transmission lines of the high-frequency line connection structure 1.

The signal line 25 is formed into a strip shape on the surface of the substrate 21, and propagates high-frequency signals. The signal line 25 is formed from a metal material. One end of the signal line 25 that is adjacent to the coaxial line 10 is electrically connected to the leading end portion 13*a* of the inner conductor 13 of the coaxial line 10.

As shown in FIG. 1B, the first adhesion layer 30 is formed covering the leading end portion 13*a* of the inner conductor 13 of the coaxial line 10 and a part of a surface of the signal line 25 of the planar line 20. The first adhesion layer 30 is conductive, and mechanically and electrically connects the coaxial line 10 and the planar line 20. Solder, conductive adhesive or the like may be used as the first adhesion layer 30. The leading end portion 13*a* of the inner conductor 13 of the coaxial line 10 and the part of the surface of the signal line 25 of the planar line 20 that are connected by the first adhesion layer 30 form the connection section 70.

The metal base 50 is provided on a back surface of the metal base 40, and supports the entire coaxial line 10 and the planar line 20. The high-frequency line connection structure 1 is integrally formed by the metal base 50. A surface of the metal base 50 is electrically connected to the metal base 40 and the outer conductor 11 of the coaxial line 10 by solder, conductive adhesive or the like (not shown).

Exactly the same potential, or in other words, a ground potential, is thereby achieved with respect to the outer conductor 11 of the coaxial line 10 and the second conductive thin film 22 of the planar line 20.

A height of the metal base 40 (a length in a direction perpendicular to a propagation direction of high-frequency signals) is adjusted in such a way that the end portion 22*a* (see FIG. 1B) of the second conductive thin film 22 of the planar line 20 is adjacent to the coaxial line 10, and is at the position of the inner wall 12 of the columnar penetrating hole formed in the outer conductor 11 of the coaxial line 10. The surface of the metal base 40 and the second conductive thin film 22 of the planar line 20 are electrically connected by solder, conductive adhesive or the like (not shown). Furthermore, an end surface of the metal base 40 that is adjacent to the coaxial line 10 is electrically connected to an end surface of the outer conductor 11 by solder, conductive adhesive or the like (not shown).

The entire second conductive thin film 22 of the planar line 20 thereby has a stable ground potential.

As shown in FIG. 1B, the second adhesion layer 60 is formed along edges that are of the pair of first conductive thin films 23 of the planar line 20 and that are adjacent to the coaxial line 10, and electrically and mechanically connects the pair of first conductive thin films 23 and the outer conductor 11 of the coaxial line 10. Solder, conductive adhesive or the like may be used as the second adhesion layer 60.

The planar line 20 and the coaxial line 10 configured in the above manner are electrically connected, and the planar line 20 thus forms a grounded coplanar line.

Furthermore, the planar line 20 in a region where the connection section 70 is not formed has a microstrip line structure in a direction away from the coaxial line 10.

The high-frequency line connection structure 1 thus minimizes a difference between a fundamental mode of an electromagnetic field formed by lines of electric force that are radially generated from an outer peripheral surface of the inner conductor 13 of the coaxial line 10 toward the inner wall 12 of the outer conductor 11, and a fundamental mode of an electromagnetic field formed by lines of electric force from the signal line 25 of the grounded coplanar line (planar line 20) to the pair of first conductive thin films 23 and the second conductive thin film 22. Generation of radiation due to non-coincidence between the fundamental modes is thereby suppressed.

Figure 1D:
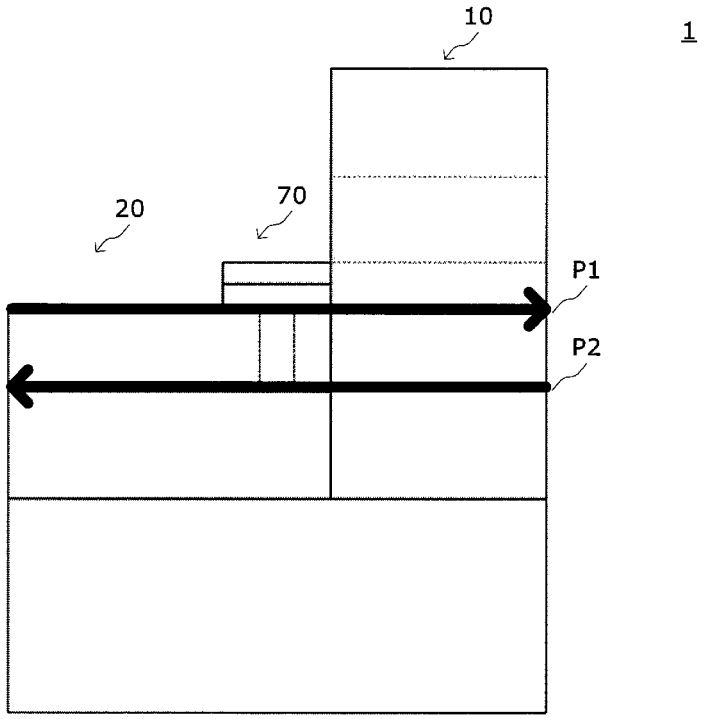
FIG. 1D is a diagram for describing a signal current path and a return current path of the high-frequency line connection structure according to the first embodiment of the present invention.

Next, a description will be given of a signal current path P1 and a return current path P2 of the high-frequency line connection structure 1. FIG. 1D is a diagram showing the signal current path P1 and the return current path P2 of the high-frequency line connection structure 1 as viewed from a side.

Figure 2:
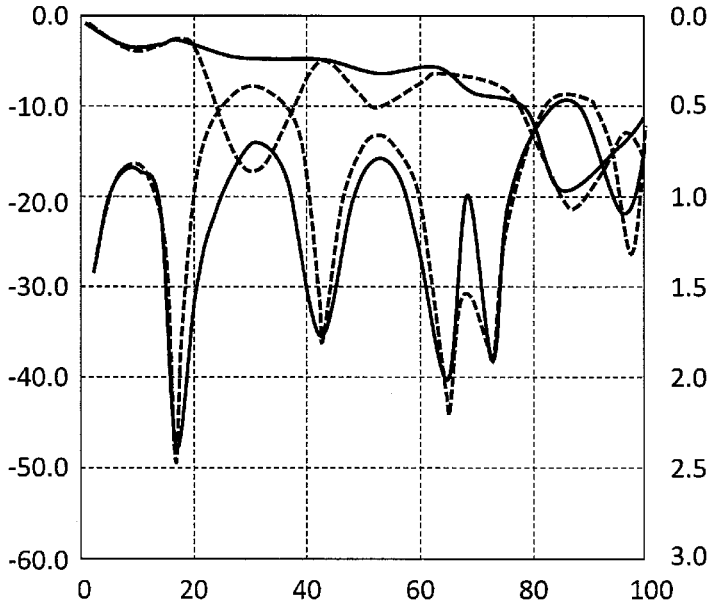
FIG. 2 is a diagram for describing an effect of the first embodiment of the present invention.

As can be seen in FIG. 1D, the return current path P2 does not make a bypass at the connection section 70 between the coaxial line 10 and the planar line 20, and a route having a same length as the signal current path P1 is formed. Resulting effects of characteristics of the high-frequency line connection structure 1 are shown in FIG. 2. Solid curved lines shown in FIG. 2 indicate a return loss (in dB) versus frequency (in GHz) and an insertion loss (in dB) versus frequency (in GHz) of the high-frequency line connection structure 1 according to the present embodiment. Furthermore, dotted curved lines indicate a return loss and an insertion loss of a high-frequency line connection structure 500A (FIGS. 5A, 5B, 5C, 5D, 5D, and 6) of a conventional example.

As can be seen in FIG. 1D, characteristics of the high-frequency line connection structure 1 according to the present embodiment are more clearly improved with respect to the return loss, compared with characteristics of the high-frequency line connection structure 500A of the conventional example. Furthermore, also with respect to the insertion loss, characteristics of the high-frequency line connection structure 1 according to the present embodiment are improved.

As described above, the high-frequency line connection structure 1 according to the first embodiment includes the conductive second adhesion layer 6*o* (see FIG. 1B) that is formed along the edges of the pair of first conductive thin films 23 of the planar line 20. Furthermore, the end portions 23*a*, 23'*a* (see FIG. 1B) of the pair of first conductive thin films 23 and the end portion 22*a* (see FIG. 1B) of the second conductive thin film 22 that is adjacent to the coaxial line 10 are disposed to coincide with the position of the inner wall 12 of the columnar penetrating hole formed in the outer conductor 11. Accordingly, the high-frequency line connection structure 1 may have a low return loss, and have low insertion loss characteristics over a wide band.

As a result, the high-frequency line connection structure 1 enables provision of electronic components and optical module components having next-generation broadband characteristics of 1 Tbps or more.

Second Embodiment

Next, a description will be given of a second embodiment of the present invention. Additionally, in the following description, structures the same as those in the first embodiment described above will be denoted by same reference signs, and description thereof will be omitted.

In the first embodiment, a case is described where a plurality of through holes 24 are provided, the through holes 24 electrically connecting the pair of first conductive thin films 23 and the second conductive thin film 22 formed at the planar line 20, on the surface and the back surface of the substrate 21, respectively. In contrast, in the second embodiment, a plurality of half through holes 24A are used instead of the plurality of through holes 24.

Figure 3A:
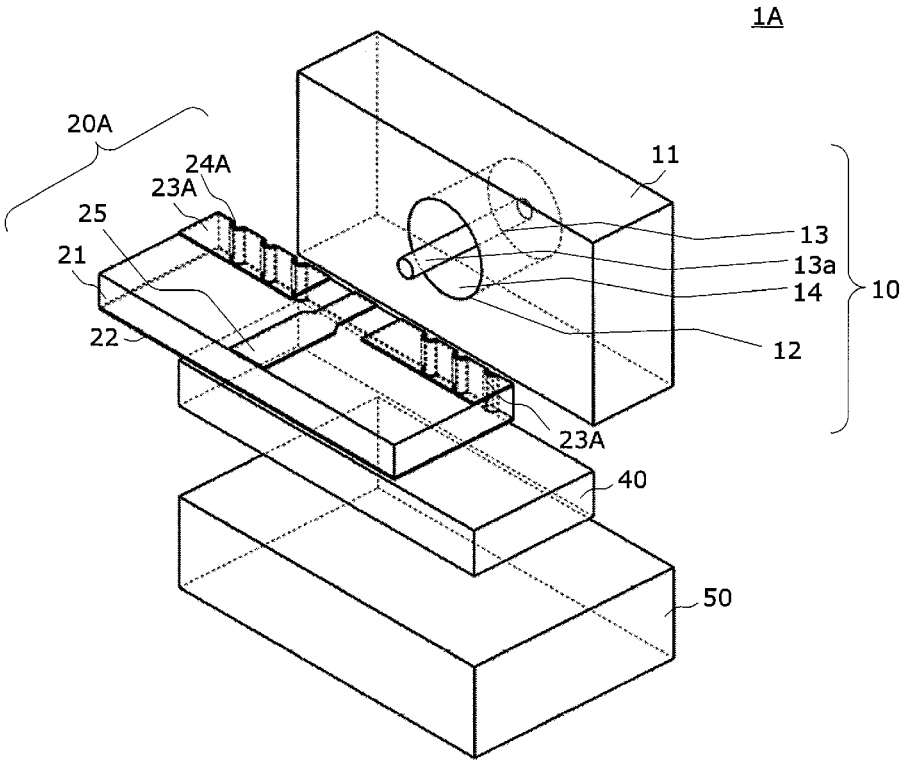
FIG. 3A is an exploded view of a high-frequency line connection structure according to a second embodiment of the present invention.
Figure 3B:
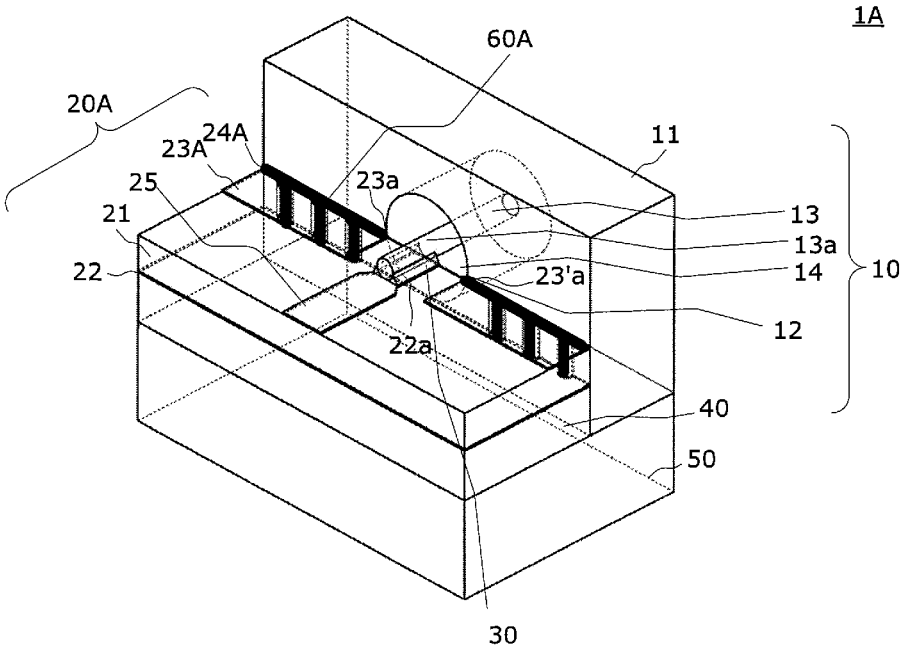
FIG. 3B is a perspective view of the high-frequency line connection structure according to the second embodiment of the present invention.
Figure 3C:
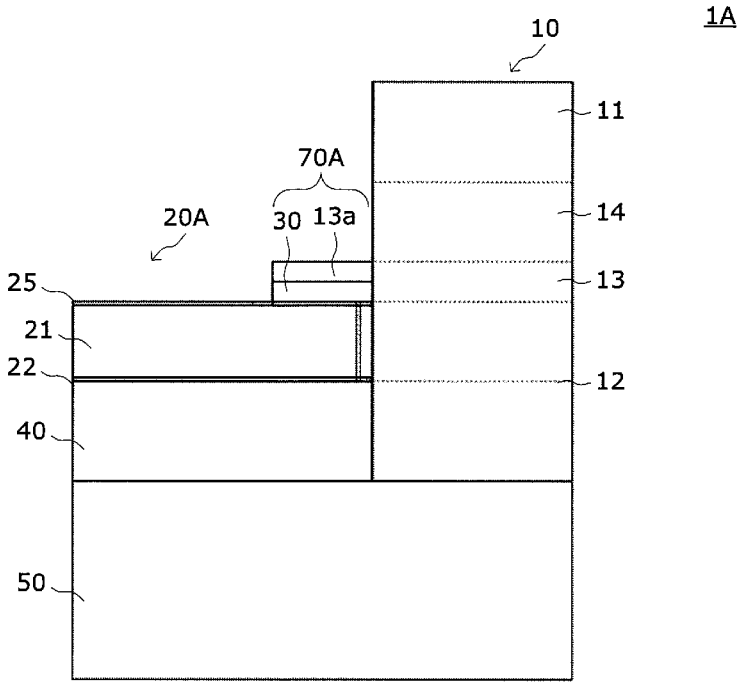
FIG. 3C is a side view of the high-frequency line connection structure according to the second embodiment of the present invention.

FIG. 3A is an exploded view of a high-frequency line connection structure 1A according to the present embodiment. FIG. 3B is a perspective view of the high-frequency line connection structure 1A. FIG. 3C is a side view of the high-frequency line connection structure 1A. In the following, structures different from those in the first embodiment will be mainly described.

The half through holes 24A (see FIGS. 3A and 3B) electrically connect a pair of first conductive thin films 23A (see FIGS. 3A and 3B) formed on the surface of the substrate 21 of the planar line 20A and the second conductive thin film 22 formed on the back surface of the substrate 21. The half through holes 24A (see FIGS. 3A and 3B) are semi-cylindrical through holes. The plurality of half through holes 24A (see FIGS. 3A and 3B) are formed with predetermined spaces therebetween, along an end surface of the substrate 21 that is adjacent to the coaxial line 10.

As shown in FIG. 3B, an end surface of the planar line 20A where the plurality of half through holes 24A are formed and an end surface of the coaxial line 10, on the side of the leading end portion 13*a* of the inner conductor 13, are positioned and connected in the manner as described in the first embodiment.

More specifically, a second adhesion layer 60A is formed on the side of the coaxial line 10 along edges of the pair of first conductive thin films 23A (see FIGS. 3A and 3B) and the pair of first conductive thin films 23A (see FIGS. 3A and 3B) and the outer conductor 11 are electrically connected. At this time, the second adhesion layer 60A also fills semi-cylindrical gaps formed between the half through holes 24A (see FIGS. 3A and 3B) and the outer conductor 11 of the coaxial line 10. For example, the second adhesion layer 60A permeates into the gaps of the half through holes 24A (see FIGS. 3A and 3B) by capillary action. Due to the second adhesion layer 60A also filling the half through holes 24A (see FIGS. 3A and 3B), the coaxial line 10 and a planar line 20A are mechanically adhered and fixed, in addition to being electrically connected. Solder, conductive adhesive or the like may be used as the second adhesion layer 60A.

Figure 3D:
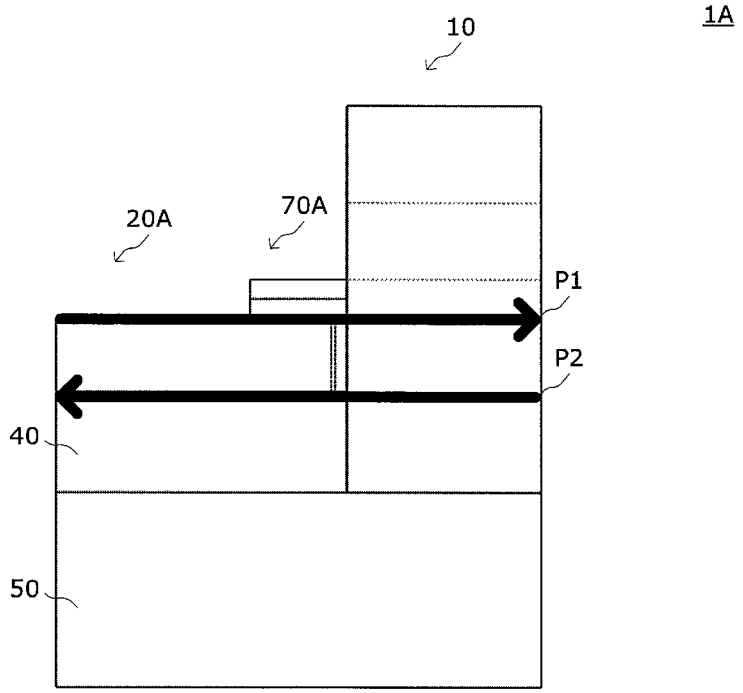
FIG. 3D is a diagram for describing a signal current path and a return current path of the high-frequency line connection structure according to the second embodiment of the present invention.

FIG. 3D is a diagram for describing the signal current path P1 and the return current path P2 of the high-frequency line connection structure 1A as viewed from a side.

As shown in FIG. 3D, the return current path P2 does not make a bypass at a connection section 70A of the high-frequency line connection structure 1A between the coaxial line 10 and the planar line 20A, and a route having a same length as the signal current path P1 is formed. Accordingly, characteristics of the high-frequency line connection structure 1A according to the present embodiment are improved in the same manner as in the first embodiment (FIG. 2). That is, compared with high-frequency characteristics of the high-frequency line connection structure 500A of the conventional example, characteristics of the high-frequency line connection structure 1A according to the present embodiment are more clearly improved with respect to the return loss, and characteristics are also improved with respect to the insertion loss.

As described above, with the high-frequency line connection structure IA according to the second embodiment, a plurality of half through holes 24A are formed in the planar line 20A, and the second adhesion layer 60A fills the half through holes 24A. Accordingly, the high-frequency line connection structure IA may increase strength of mechanical connection between the coaxial line 10 and the planar line 20A, and may have low return loss and low insertion loss characteristics over a wide band.

Third Embodiment

Next, a description will be given of a third embodiment of the present invention. Additionally, in the following description, structures the same as those in the first and second embodiments described above will be denoted by same reference signs, and description thereof will be omitted.

The first and second embodiments each describe a case where the end portion 22*a* (see FIG. 1B) that is of the second conductive thin film 22 of the planar line 20, 20A and that is adjacent to the coaxial line 10 is positioned to coincide with the position of the inner wall 12 of the columnar penetrating hole formed in the outer conductor 11. In contrast, in the third embodiment, a substrate 21B is formed to have a thickness (a length in a direction perpendicular to a lengthwise direction of the signal line 25) smaller than a thickness of the substrate 21 of the planar line 20, 20A described in the first and second embodiments.

Figure 4A:
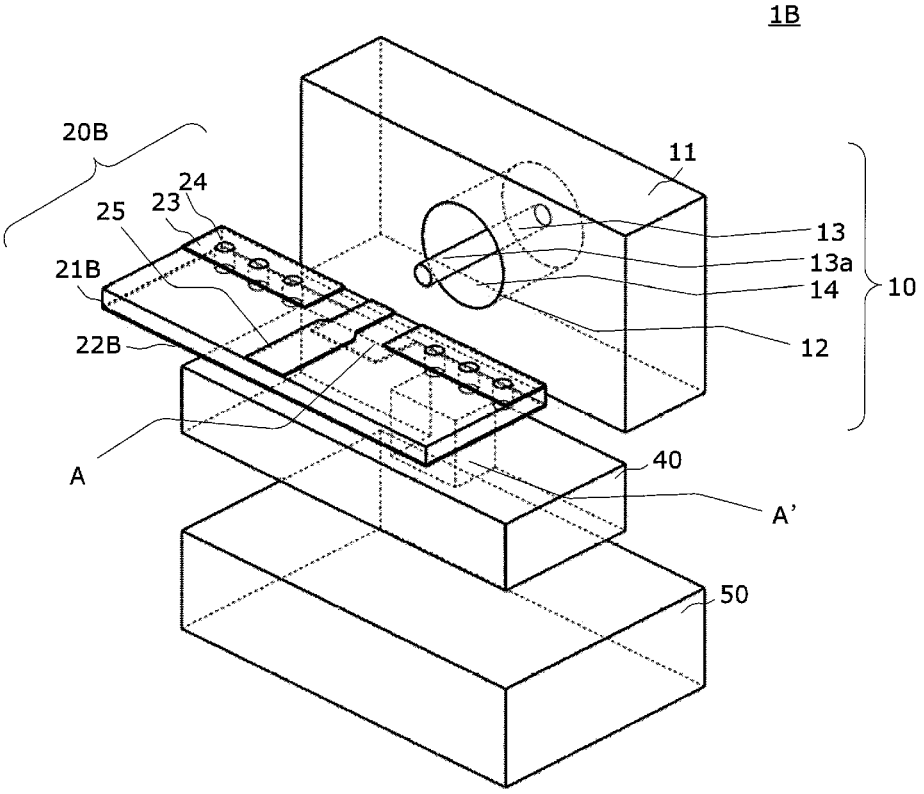
FIG. 4A is an exploded view of a high-frequency line connection structure according to a third embodiment of the present invention.
Figure 4B:
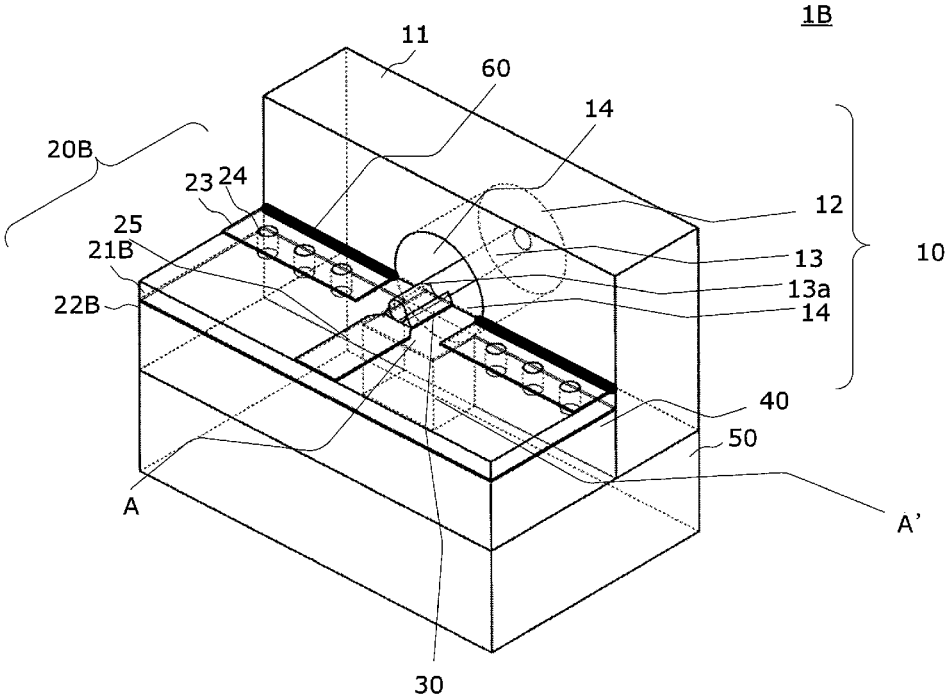
FIG. 4B is a perspective view of the high-frequency line connection structure according to the third embodiment of the present invention.
Figure 4C:
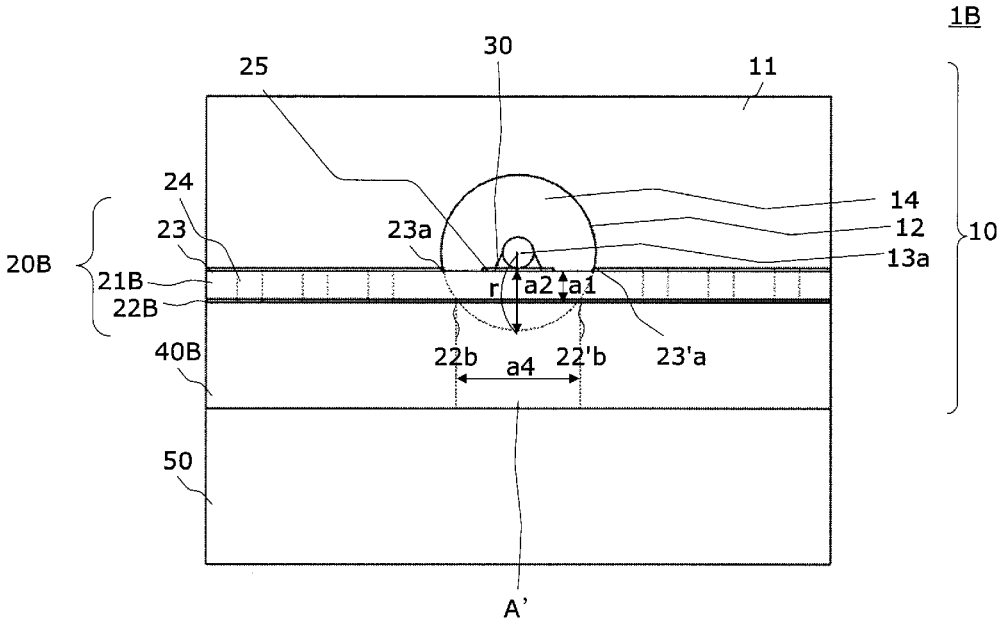
FIG. 4C is a front view of the high-frequency line connection structure according to the third embodiment of the present invention.
Figure 4D:
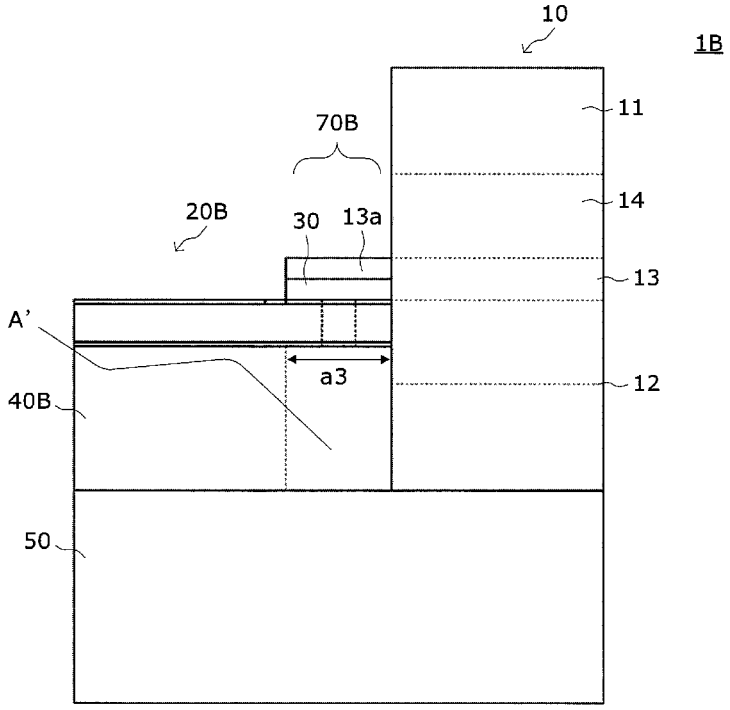
FIG. 4D is a side view of the high-frequency line connection structure according to the third embodiment of the present invention.

FIG. 4A is an exploded view of a high-frequency line connection structure 1B according to the third embodiment. FIG. 4B is a perspective view of the high-frequency line connection structure 1B. FIG. 4C is a front view of the high-frequency line connection structure 1B. Furthermore, FIG. 4D is a side view of the high-frequency line connection structure 1B. In the following, structures different from those in the first and second embodiments will be mainly described.

As shown in the front view in FIG. 4C, a thickness a1 of the substrate 21B of a planar line 20B, or in other words, the length in the direction perpendicular to the lengthwise direction of the signal line 25, is sufficiently smaller than a radius r of a concentric circle of the coaxial line 10. More specifically, the thickness a1 of the substrate 21B is smaller than a length a2 from a point on a circumference of the inner conductor 13 along the radius r to the inner wall 12 of the outer conductor 11.

As shown in FIGS. 4A and 4B, a cutaway part A is formed in a second conductive thin film 22B provided on a back surface of the substrate 21B of the planar line 20B. More specifically, the cutaway part A is formed by selectively removing a region including a connection section 70B, such as a region immediately below the connection section 70B, for example. The substrate 21B is exposed at the region where the second conductive thin film 22B is removed.

The cutaway part A has a rectangular shape in plan view, and may be formed, for example, such that a length a3 (see FIG. 4D) of one side along the lengthwise direction of the signal line 25 is substantially the same as a length of the leading end portion 13*a* of the inner conductor 13 of the coaxial line 10 in an extension direction.

Furthermore, as shown in FIG. 4C, a length a4 of another side of the cutaway part A, along a widthwise direction of the signal line 25, is a length by which end portions 22*b*, 22'*b* of the second conductive thin film 22B coincide with the position of the inner wall 12 of the columnar penetrating hole of the outer conductor 11. The end portions 22*b*, 22'*b* of the second conductive thin film 22B that are adjacent to the cutaway part A thus coincide with the position of the inner wall 12 of the outer conductor 11.

A height of the metal base 40B (a length in a direction perpendicular to a propagation direction of high-frequency signals) is adjusted according to a thickness of the planar line 20B. A cutaway part A' corresponding to a shape of the cutaway part A formed in the second conductive thin film 22B is formed in the metal base 40B. More specifically, the cutaway part A' is oriented in a direction away from an end surface of the metal base 40B that is adjacent to the coaxial line 10, and is formed penetrating the metal base 40B from a surface to a back surface. An opening is formed in the end surface of the metal base 40B that is adjacent to the coaxial line 10 due to the cutaway part A' being formed.

For example, when the planar line 20B is viewed from top, the cutaway part A' has a rectangular cross-section that has lengths a3, a4 (see FIGS. 4D and 4C, respectively) that are substantially the same as those of the cutaway part A formed in the second conductive thin film 22B. Additionally, the cutaway part A' is not limited to have a rectangular cross-section, but may be formed according to the shape of the cutaway A formed in the second conductive thin film 22B.

As described above, in the present embodiment, the substrate 21B having a smaller thickness than those in the first and second embodiments is used. Generally, characteristic impedance is proportional to the square root of a reciprocal of electrical capacitance. An increase in the electrical capacitance causes reduction in the characteristic impedance.

In the present embodiment, the region A and the cutaway part A' are formed immediately below the connection section 70B, and a region where the second conductive thin film 22B and the metal base 40B are selectively removed is provided. Reduction in the characteristic impedance caused by an increase in the electrical capacitance may thereby be suppressed.

Figure 4E:
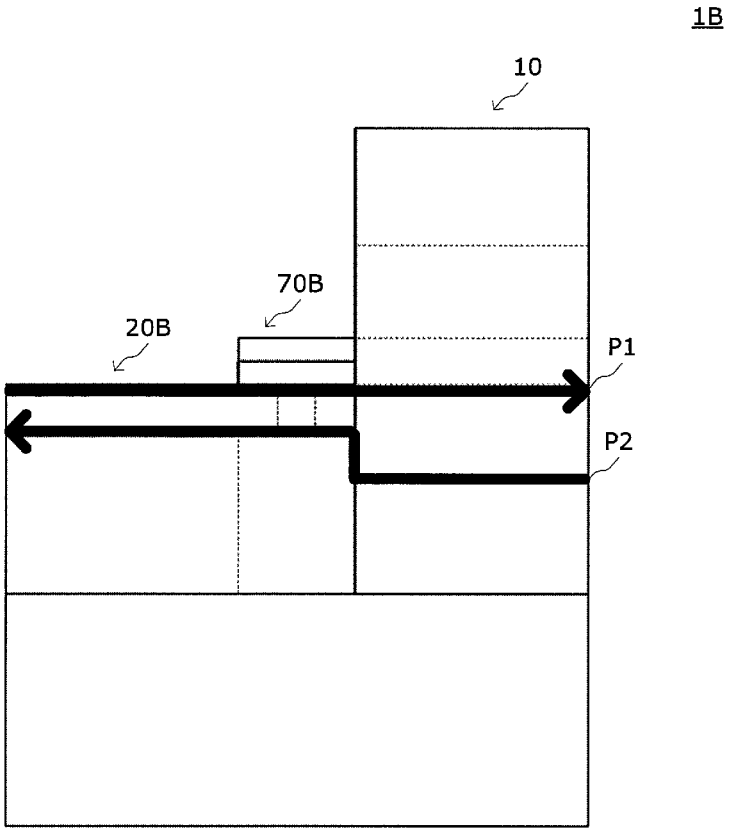
FIG. 4E is a diagram for describing a signal current path and a return current path of the high-frequency line connection structure according to the third embodiment of the present invention.
Figure 5A:
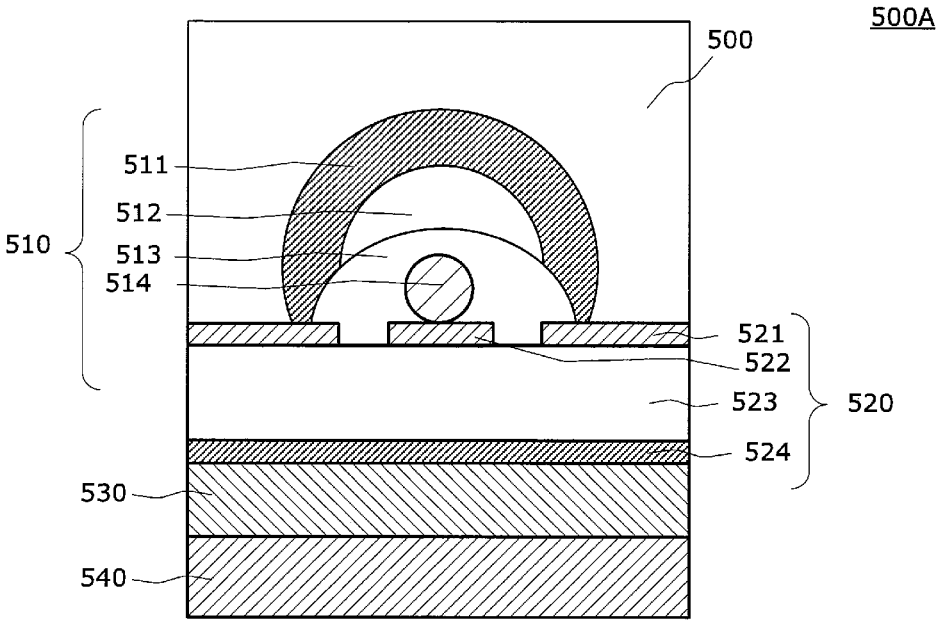
Fig. 5A (Prior Art)
FIG. 5A is a front view of a conventional high-frequency line connection structure.
Figure 5B:
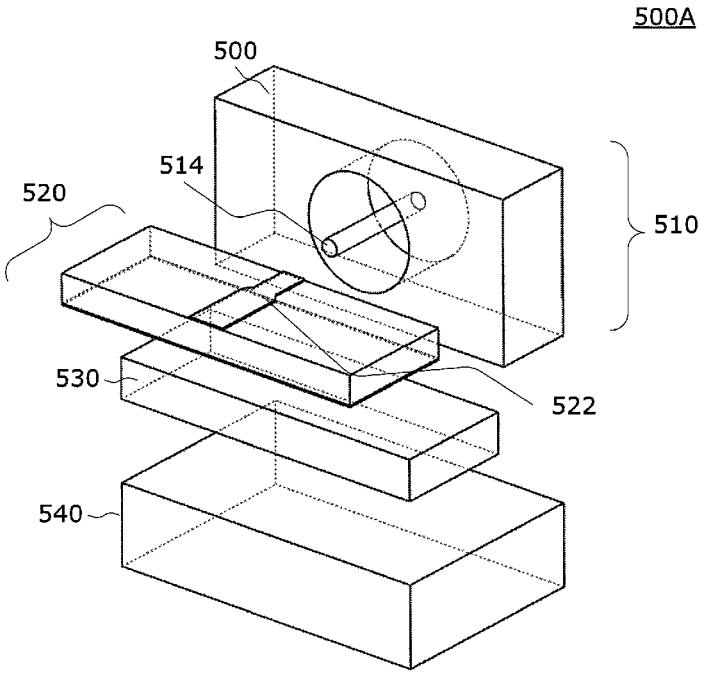
Fig. 5B (Prior Art)
FIG. 5B is an exploded view of the conventional high-frequency line connection structure.
Figure 5C:
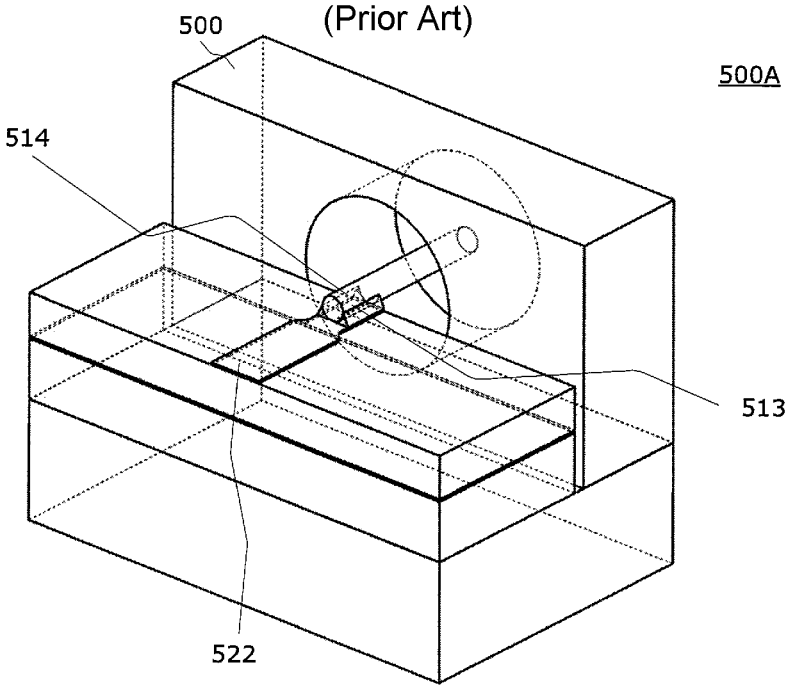
Fig. 5C (Prior Art)
FIG. 5C is a perspective view of the conventional high-frequency line connection structure.
Figure 5D:
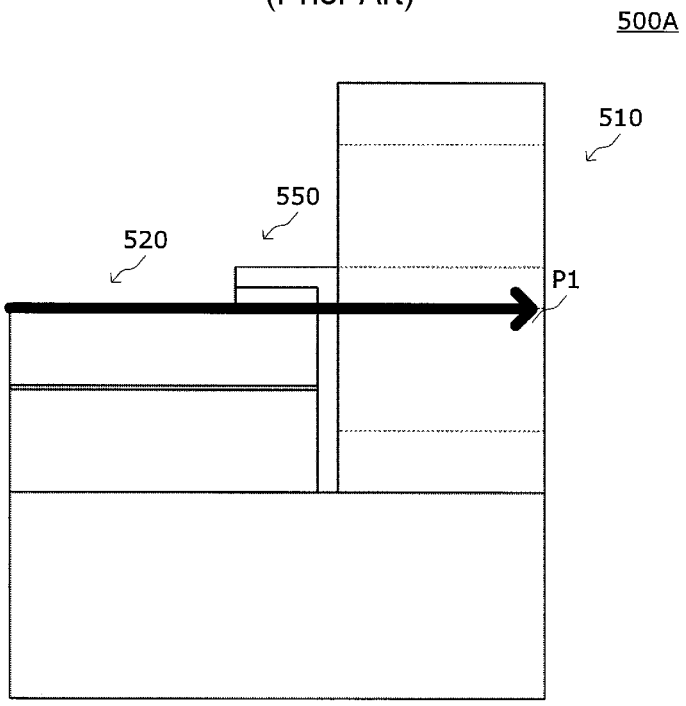
Fig. 5D (Prior Art)
FIG. 5D is a diagram for describing a signal current path of the conventional high-frequency line connection structure.
Figure 5E:
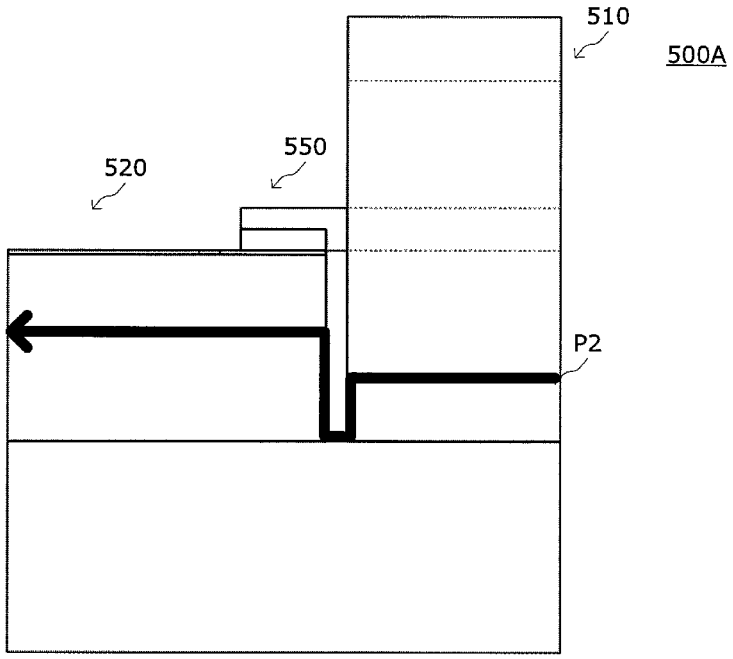
Fig. 5E (Prior Art)
FIG. 5E is a diagram for describing a return current path of the conventional high-frequency line connection structure.
Figure 6:
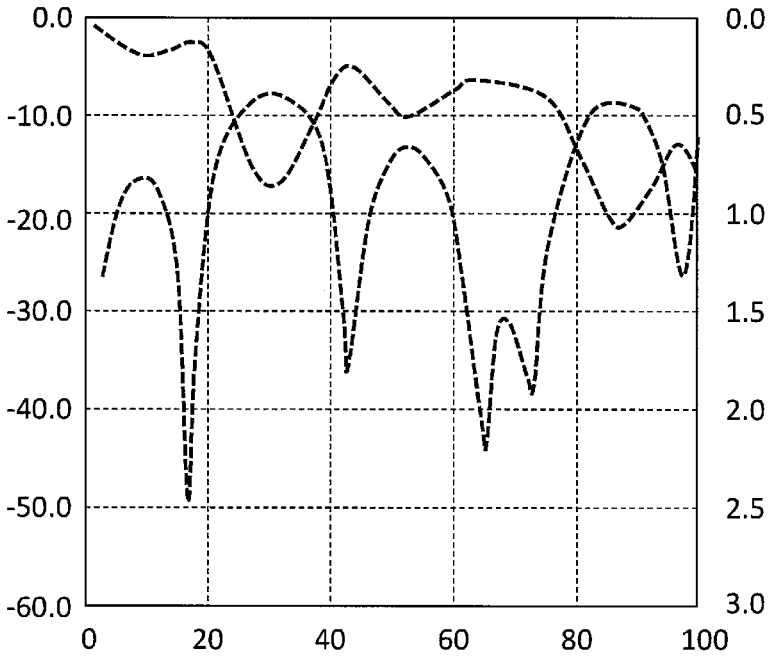
Fig. 6 (Prior Art)
FIG. 6 is a diagram for describing a return loss and an insertion loss of the conventional high-frequency line connection structure.

FIG. 4E is a diagram for describing the signal current path P1 and the return current path P2 of the high-frequency line connection structure 1B as viewed from a side.

As shown in FIG. 4E, a bypass of the return current path P2 is almost non-existent at the connection section 70B between the coaxial line 10 and the planar line 20B. Accordingly, high-frequency characteristics of the high-frequency line connection structure 1B according to the present embodiment are also improved in substantially the same manner as in the first and second embodiments (FIG. 2).

Accordingly, compared with the high-frequency line connection structure 500A of the conventional example, the high-frequency line connection structure 1B according to the present embodiment is more clearly improved with respect to the return loss, and furthermore, with respect to the insertion loss.

As described above, with the high-frequency line connection structure 1B according to the third embodiment, the thickness a1 of the substrate 21B is sufficiently smaller than the radius r of the concentric circle of the coaxial line 10. Furthermore, the end portions 23*a*, 23'*a* (see FIG. 4C) that are of the pair of first conductive thin films 23 of the planar line 20B and that are close to the signal line 25 are disposed to coincide with the position of the inner wall 12 of the outer conductor 11, and also, the end portions 22*b*, 22'*b* of the second conductive thin film 22B that are adjacent to the cutaway part A are disposed to coincide with the position of the inner wall 12 of the columnar penetrating hole formed in the outer conductor 11.

The high-frequency line connection structure 1B may thus achieve a low return loss, and low insertion loss characteristics over a wide band. Furthermore, mechanical strength of the high-frequency line connection structure 1B is increased because the coaxial line 10 and the planar line 20B are mechanically connected by the first adhesion layer 30 (see FIG. 4B) and the second adhesion layer 60, in addition to being electrically connected.

Heretofore, embodiments of the high-frequency line connection structure of the present invention have been described, but the present invention is not limited to the embodiments described, and may be modified in various ways conceivable to those skilled in the art within the scope of the invention described in the claims.

Additionally, in the embodiments described above, the substrate 21 forming the grounded coplanar line (planar line 20, 20A, 20B) is low-loss ceramics such as alumina, but liquid crystal polymer, polyimide, quartz glass or the like may also be used as the substrate 21.

Furthermore, in the embodiments described above, at the time of electrically connecting the coaxial line 10 and the grounded coplanar line (planar line 20, 20A, 20B) by the first adhesion layer 30 and the second adhesion layer 60, 60A, such as solders, gold plating is generally applied to the connection section 70, 70A, 70B at the lines to improve wettability of solders. However, gold plating is not an essential feature of the present invention, and description thereof is omitted.

REFERENCE SIGNS LIST

1, 1A, 1B high-frequency line connection structure
10 coaxial line
11 outer conductor
12 inner wall
13 inner conductor
13*a* leading end portion
14 insulation layer
20 planar line
21 substrate
22 second conductive thin film
23 first conductive thin film
24 through hole
25 signal line
30 first adhesion layer
60 second adhesion layer
40, 50 metal base
70 connection section.

The invention claimed is:

1. A method for forming a high-frequency line connection structure connecting a coaxial line and a planar line, the method comprising:

covering a leading end portion of an inner conductor of the coaxial line and an end of a signal line included in the planar line with a first conductive adhesion layer, wherein the inner conductor extends in an axial direction and has a circular cross-section around an axis, the circular cross-section being perpendicular to the axial direction, wherein the coaxial line comprises:

the inner conductor;

an outer conductor comprising a penetrating hole housing the inner conductor, the penetrating hole having a columnar shape, wherein the leading end portion of the inner conductor extends in the axial direction from an end surface of the outer conductor; and an insulation layer disposed in the penetrating hole between the inner conductor and the outer conductor;

disposing a second conductive adhesion layer on a side of the coaxial line along edges of a pair of first conductive thin films of the planar line to connect the pair of first conductive thin films and the outer conductor of the coaxial line, wherein the planar line comprises:

a dielectric substrate;

the signal line disposed on a surface of the dielectric substrate;

the pair of first conductive thin films on the surface of the dielectric substrate and adjacent to the coaxial line, the pair of first conductive thin films disposed on opposing sides of the signal line across a predetermined distance such that end portions of the pair of first conductive thin films are facing the signal line; and a second conductive thin film that covers a back surface of the dielectric substrate, the second conductive thin film being electrically connected to the pair of first conductive thin films, wherein when seen along the axial direction, the end portions of the air of first conductive thin films align with an inner peripheral surface of the penetrating hole, wherein the inner peripheral surface has the columnar shape.

2. The method according to claim 1, wherein when viewed along the axial direction, an end portion of the second conductive thin film that is adjacent to the coaxial line coincides with the inner wall of the penetrating hole.

3. The method according to claim 1, wherein:

a length of the dielectric substrate in a direction perpendicular to a lengthwise direction of the signal line is smaller than a radius of a concentric circle of the coaxial line;

a cutaway part is disposed in the second conductive thin film of the planar line;

the cutaway part is disposed under a connection section as viewed from top, the connection section being formed by connecting the leading end portion of the inner conductor of the coaxial line and a surface of the signal line by the first conductive adhesion layer; and end portions of the second conductive thin film that are adjacent to the cutaway part coincide with the inner wall of the penetrating hole.

4. The method according to claim 1, wherein:

the planar line further includes a plurality of through holes for providing electrical continuity between the pair of first conductive thin films and the second conductive thin film, wherein the plurality of through holes extends through the dielectric substrate.

5. The method according to claim 1, wherein:

the planar line further includes a plurality of half through holes for providing electrical continuity between the pair of first conductive thin films and the second conductive thin film, the half through holes being disposed in an end surface of the dielectric substrate that is adjacent to the coaxial line, wherein the half through holes extend into the dielectric substrate; and the second conductive adhesion layer fills the plurality of half through holes.

6. A high-frequency line connection structure for connecting a coaxial line and a planar line, comprising:

a first conductive adhesion layer covering a leading end portion of an inner conductor of the coaxial line and an end of a signal line included in the planar line, wherein the inner conductor extends in an axial direction and has a circular cross-section around an axis, the circular cross-section being perpendicular to the axial direction, wherein the coaxial line comprises:

the inner conductor;

an outer conductor comprising a penetrating hole housing the inner conductor, the penetrating hole having a columnar shape, wherein the leading end portion of the inner conductor extends in the axial direction from an end surface of the outer conductor; and an insulation layer disposed in the penetrating hole between the inner conductor and the outer conductor;

a second conductive adhesion layer disposed on a side of the coaxial line along edges of a pair of first conductive thin films of the planar line to connect the pair of first conductive thin films and the outer conductor of the coaxial line, wherein the planar line comprises:

a dielectric substrate;

the signal line disposed on a surface of the dielectric substrate;

the pair of first conductive thin films on the surface of the dielectric substrate and adjacent to the coaxial line, the pair of first conductive thin films disposed on opposing sides of the signal line across a predetermined distance such that end portions of the pair of first conductive thin films are facing the signal line; and a second conductive thin film that covers a back surface of the dielectric substrate, the second conductive thin film being electrically connected to the pair of first conductive thin films, wherein when seen along the axial direction, the end portions of the pair of first conductive thin films coincide with an inner peripheral surface of the penetrating hole, wherein the inner peripheral surface has the columnar shape.

7. The high-frequency line connection structure according to claim 6, wherein when viewed along the axial direction, an end portion of the second conductive thin film that is adjacent to the coaxial line coincides with the inner wall of the penetrating hole.

8. The high-frequency line connection structure according to claim 6, wherein:

a length of the dielectric substrate in a direction perpendicular to a lengthwise direction of the signal line is smaller than a radius of a concentric circle of the coaxial line;

a cutaway part is disposed in the second conductive thin film of the planar line;

the cutaway part is disposed under a connection section as viewed from top, the connection section being formed by connecting the leading end portion of the inner conductor of the coaxial line and a surface of the signal line by the first conductive adhesion layer; and end portions of the second conductive thin film that are adjacent to the cutaway part coincide with the inner wall of the penetrating hole.

9. The high-frequency line connection structure according to claim 6, wherein:

the planar line further includes a plurality of through holes for providing electrical continuity between the pair of first conductive thin films and the second conductive thin film, wherein the plurality of through holes extends through the dielectric substrate.

10. The high-frequency line connection structure according to claim 6, wherein:

the planar line further includes a plurality of half through holes for providing electrical continuity between the pair of first conductive thin films and the second conductive thin film, the half through holes being disposed in an end surface of the dielectric substrate that is adjacent to the coaxial line, wherein the half through holes extend into the dielectric substrate; and the second conductive adhesion layer fills the plurality of half through holes.

11. A high-frequency line connection structure for connecting a coaxial line and a planar line, comprising:

a first conductive adhesion layer covering a leading end portion of an inner conductor of the coaxial line and an end of a signal line included in the planar line, wherein the coaxial line comprises:

the inner conductor;

an outer conductor comprising a penetrating hole housing the inner conductor; and an insulation layer disposed in the penetrating hole between the inner conductor and the outer conductor;

a second conductive adhesion layer disposed on a side of the coaxial line along edges of a pair of first conductive thin films of the planar line to connect the pair of first conductive thin films and the outer conductor of the coaxial line, wherein the planar line comprises:

a dielectric substrate;

the signal line disposed on a surface of the dielectric substrate;

the pair of first conductive thin films on the surface of the dielectric substrate and adjacent to the coaxial line, the pair of first conductive thin films disposed on opposing sides of the signal line such that end portions of the pair of first conductive thin films are facing the signal line; and a second conductive thin film that covers a back surface of the dielectric substrate, the second conductive thin film being electrically connected to the pair of first conductive thin films, wherein the end portions of the pair of first conductive thin films coincide with an inner peripheral surface of the penetrating hole when seen along an axial direction, wherein the inner peripheral surface has a columnar shape.

12. The high-frequency line connection structure according to claim 11, wherein:

the planar line further includes a plurality of half through holes for providing electrical continuity between the pair of first conductive thin films and the second conductive thin film, the half through holes being disposed in an end surface of the dielectric substrate that is adjacent to the coaxial line, wherein the half through holes extend into the dielectric substrate; and the second conductive adhesion layer fills the plurality of half through holes.

13. The high-frequency line connection structure according to claim 11, wherein:

the planar line further includes a plurality of through holes for providing electrical continuity between the pair of first conductive thin films and the second conductive thin film, wherein the plurality of through holes extends through the dielectric substrate.

14. The high-frequency line connection structure according to claim 11, wherein:

a length of the dielectric substrate in a direction perpendicular to a lengthwise direction of the signal line is smaller than a radius of a concentric circle of the coaxial line;

a cutaway part is disposed in the second conductive thin film of the planar line;

the cutaway part is disposed under a connection section as viewed from top, the connection section being formed by connecting the leading end portion of the inner conductor of the coaxial line and a surface of the signal line by the first conductive adhesion layer; and end portions of the second conductive thin film that are adjacent to the cutaway part coincide with the inner wall of the penetrating hole.

15. The high-frequency line connection structure according to claim 11, wherein the leading end portion of the inner conductor extends in the axial direction from an end surface of the outer conductor.

16. The high-frequency line connection structure according to claim 11, wherein the penetrating hole has the columnar shape.

17. The high-frequency line connection structure according to claim 11, wherein the inner conductor extends in the axial direction and has a circular cross-section around an axis, the circular cross-section being perpendicular to the axial direction.

* * * * *